US010744669B2

(12) United States Patent
Lee

(10) Patent No.: US 10,744,669 B2
(45) Date of Patent: Aug. 18, 2020

(54) NICK BREAKING DEVICE

(71) Applicant: ACE MACHINERY CO., LTD., Siheung-si, Gyeonggi-do (KR)

(72) Inventor: Chul Lee, Goyang-si (KR)

(73) Assignee: ACE MACHINERY CO., LTD., Siheung-si, Gyeonggi-do (KR)

( * ) Notice: Subject to any disclaimer, the term of this patent is extended or adjusted under 35 U.S.C. 154(b) by 0 days.

(21) Appl. No.: 16/312,298

(22) PCT Filed: Jun. 23, 2016

(86) PCT No.: PCT/KR2016/006706
§ 371 (c)(1),
(2) Date: Dec. 21, 2018

(87) PCT Pub. No.: WO2017/222092
PCT Pub. Date: Dec. 28, 2017

(65) Prior Publication Data

US 2019/0232518 A1 Aug. 1, 2019

(51) Int. Cl.

| | |
|---|---|
| ***B26F 3/00*** | (2006.01) |
| ***B31B 50/92*** | (2017.01) |
| ***B26D 7/18*** | (2006.01) |

(52) U.S. Cl.
CPC ..... *B26F 3/002* (2013.01); *B26D 7/1818* (2013.01); *B26F 3/00* (2013.01); *B31B 50/92* (2017.08)

(58) Field of Classification Search
CPC . B26F 3/002; B26F 3/00; B31B 50/92; B26D 7/1818
See application file for complete search history.

(56) References Cited

U.S. PATENT DOCUMENTS

| | | | | |
|---|---|---|---|---|
| 4,033,240 A * | 7/1977 | Deslauriers | B26D 7/1818 493/373 |
| 5,014,582 A | 5/1991 | Teik | |
| 5,100,040 A * | 3/1992 | Kunreuther | B26F 3/002 225/100 |
| 6,159,137 A * | 12/2000 | Lee | B26D 7/2621 493/151 |
| 6,257,475 B1 * | 7/2001 | Ishii | B26F 3/002 225/100 |
| 6,729,217 B2 * | 5/2004 | Loewensberg | B26D 5/34 493/473 |

(Continued)

FOREIGN PATENT DOCUMENTS

| | | |
|---|---|---|
| EP | 1184143 A2 | 3/2002 |
| KR | 10-0390559 B1 | 7/2003 |

(Continued)

OTHER PUBLICATIONS

International Search Report for PCT/KR2016/006706 dated Jan. 24, 2017 from Korean Intellectual Property Office.

*Primary Examiner* — Omar Flores Sanchez
(74) *Attorney, Agent, or Firm* — Revolution IP, PLLC

(57) ABSTRACT

A nick breaking device includes: a conveyor forming a transfer path on which a plate-shaped element having nicks formed thereon is transferred; and one or more pressing rollers provided on the transfer path of the nicks of the plate-shaped element so as to press the plate-shaped element such that the plate-shaped element is transferred while having a continuous wave shape and to break the nicks formed on the plate-shaped element.

5 Claims, 6 Drawing Sheets

(56) References Cited

U.S. PATENT DOCUMENTS

| | | | | |
|---|---|---|---|---|
| 8,684,657 | B2 * | 4/2014 | Pini | B65H 11/002 414/759 |
| 9,156,180 | B2 * | 10/2015 | Horii | B26D 7/18 |
| 2002/0077236 | A1 | 6/2002 | Chalendar et al. | |
| 2003/0224919 | A1 | 12/2003 | Joux | |
| 2011/0297507 | A1 * | 12/2011 | Pini | B65H 29/12 198/379 |
| 2014/0318338 | A1 * | 10/2014 | Horii | B26D 7/18 83/102 |

FOREIGN PATENT DOCUMENTS

| | | | |
|---|---|---|---|
| KR | 10-0546427 | B1 | 1/2006 |
| KR | 10-2015-0061601 | A | 6/2015 |

* cited by examiner

【FIG. 6】
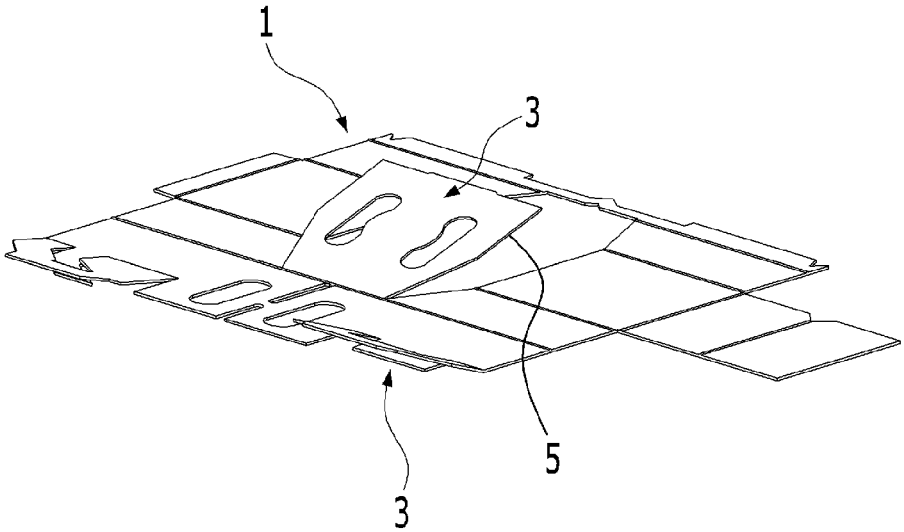

NICK BREAKING DEVICE

TECHNICAL FIELD

The present invention relates to a nick breaking device, and more particularly to a nick breaking device for breaking a nick that partially connects opposite ends of a cutting line of a flap provided on a plate-shaped element.

BACKGROUND ART

In order to obtain a folded box for packaging by using a plate-shaped element that is a paper plate or a black in a general packaging machine, the plate-shaped element is carried via several stations and undergoes a process of being folded or pasted.

An embodiment of such a plate-shaped element having a nick 6 is illustrated in FIG. 5.

As illustrated in FIG. 5, a partially cut flap is formed in the plate-shaped element according to the form of the packaging state, and opposite ends of the cutting line of the flap are partially connected to a plate surface of the plate-shaped element by the nick 6.

In particular, when a specific plate-shaped element that is folded along the cutting line for forming a box is cut, it is useful to connect opposite ends of the cutting line of at least some flaps to the plate surface of the plate-shaped element such that the plate-shaped elements are not bonded to each other.

As illustrated in FIG. 5, the nicks 6 may be spaced apart from each other along the cutting line of the flap, and the nick 6 has to be broken before an operation of folding the plate-shaped element is performed when the nick 6 is introduced into a process of folding and pasting the plate-shaped element.

Meanwhile, as a prior technology of a device for breaking the nick, a device for breaking a nick connecting two edges of a cutting line is disclosed in Korean Patent No. 10-0390559.

As disclosed in the prior technology, the conventional device for breaking a nick has a structure in which a parallel shaft is coupled onto a planar path of a blank as a plate-shaped element to be rotatable and a tool support part that causes a shear force between adjacent edges of a cutting line such that the nick of the blank is broken is coupled to the parallel shaft to be rotatable. A tool that breaks the nick while rotating along a rotation locus of the tool support part is disposed at an outer periphery of the tool support part.

However, in the conventional device for breaking a nick, because the length and the transfer speed of the blank that is a plate-shaped element that moves on the planar path and the rotational speed of the parallel shaft have to be adjusted to break a nick that is a plate-shaped element as the tool support part that breaks the nick is coupled to a parallel shaft to be rotatable, the control of the device is complex and the overall structure of the device is also complex.

Further, in the conventional device for breaking a nick, the tool support part that breaks a nick according to the length of the blank and the form of the nick formed in the blank has to be replaced, productivity deteriorates.

(Prior patent document 1) Korean Patent No. 10-0390559 (entitled: Device for Breaking Nick Connecting Two Edges of Cutting Line, Published on Jun. 26, 2003)

DISCLOSURE

Technical Problem

The present invention is made in an effort solve the above-mentioned problems, and provides a nick breaking device that may break a nick that is a plate-shaped element regardless of the form and the location of the nick and may improve productivity.

Technical Solution

In accordance with an aspect of the present invention, there is provided a nick breaking device comprising: a conveyor that forms a transfer path on which a plate-shaped element having a nick is transferred; and one or more pressing rollers provided on a transfer path of the nick of the plate-shaped element, configured to press the plate-shaped element such that the plate-shaped element forms a continuous wave shape, and configured to break the nick formed in the plate-shaped element.

The nick breaking device may further comprise: a plurality of transfer rollers disposed in a row at an interval along the transfer path of the conveyor to be rolled, and the pressing rollers are provided between the pair of adjacent transfer rollers.

A rolling surface of the pressing roller that contacts the plate-shaped element may be located below a rolling surface of the transfer roller that contacts the plate-shaped element.

The nick breaking device may further comprise: a spring configured to provide a resilient force to the pressing roller such that the pressing roller contacts the nick of the plate-shaped element; and a roller configured to support the spring.

The nick breaking device may further comprise: a carrier support part configured to move a location of the roller carrier along the transfer path of the conveyor and configured to support the roller carrier such that the height of the roller carrier with respect to the transfer path of the conveyor is adjusted.

The nick breaking device may further comprise: a guide rail disposed on the upper side of the conveyor transversely with respect to the transfer path of the conveyor and to which the carrier support pate is coupled to be movable.

Advantageous Effects

The present invention may break the nick of the plate-shaped element regardless of the length and the transfer speed of the plate-shaped element, may break a nick that is a plate-shaped element regardless of the form and the location of the nick, and may improve productivity.

DESCRIPTION OF THE INVENTION

FIG. 6 is a view of a state in which the nick of the plate-shaped element of FIG. 5 is broken.

BEST MODE

Hereinafter, the present invention will be described in detail with reference to the accompanying drawings.

Prior to a detailed description of the present invention, it will be understood that a plate-shaped element 1 refers to the one that is manufactured of a plate or a blank to obtain a folded box for packing in the following description.

Figure 5:
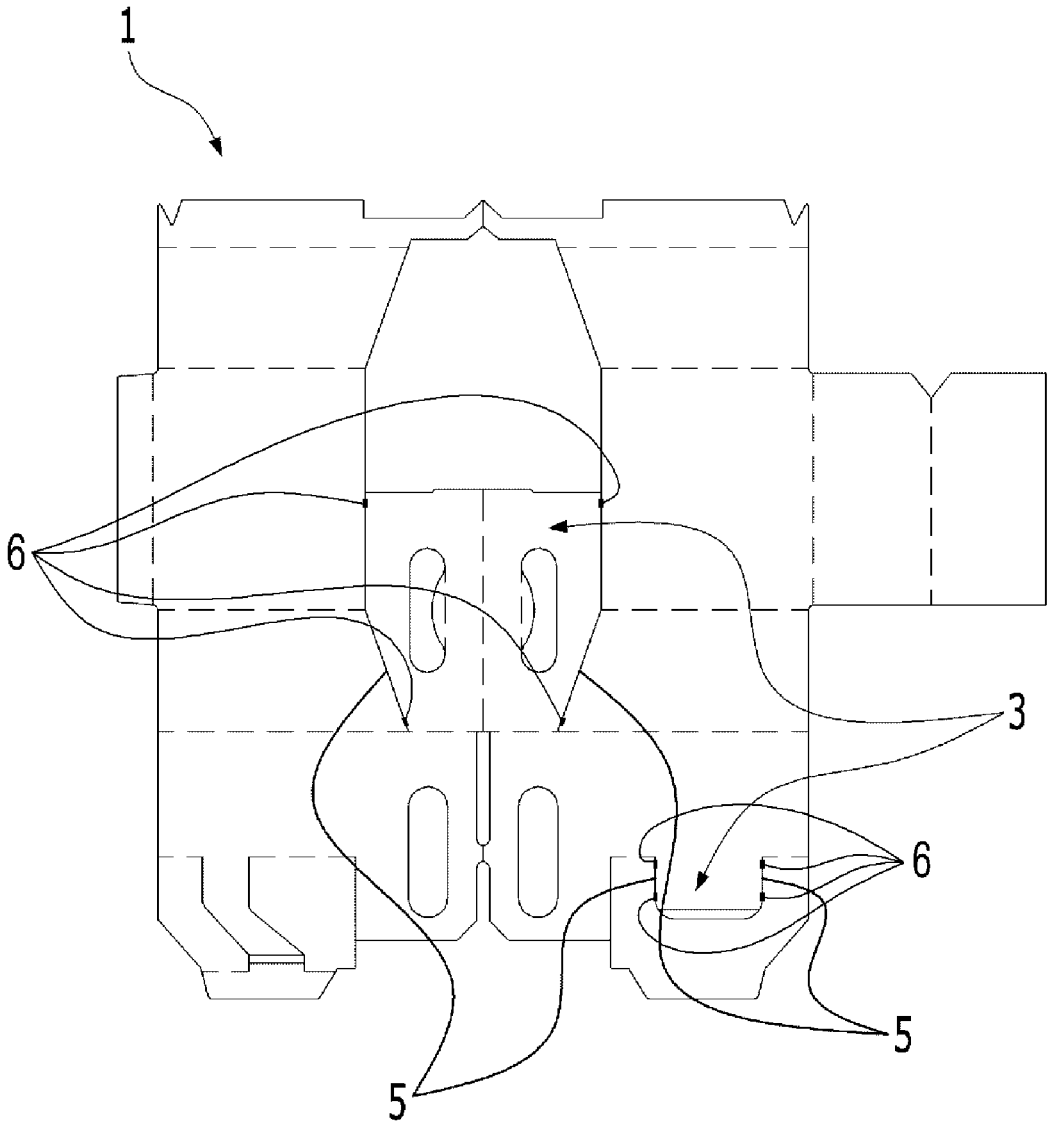
FIG. 5 is a view of an embodiment of the plate-shaped element before a nick is broken.

Further, in a brief description of the nick formed in the plate-shaped element 1, as illustrated in FIG. 5, a partially cut flap 3 is formed in the plate-shaped element 1, and opposite ends of a cutting line 5 of the flap 3 is partially connected to a plate surface of the plate-shaped element 1 by the nick 6. A nick breaking device for breaking the nick 6 will be described in detail with reference to the accompanying drawings.

Figure 1:
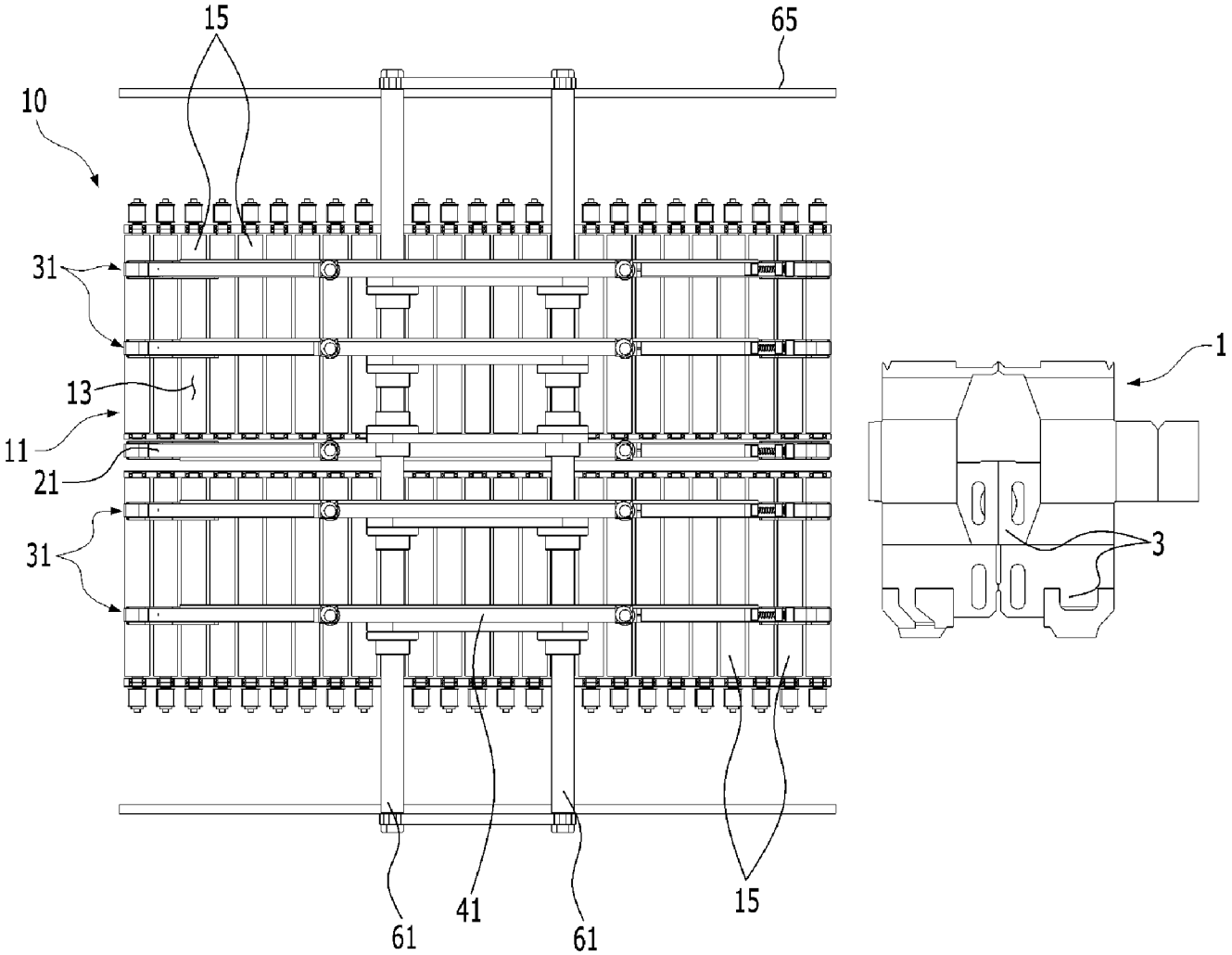
FIG. 1 is a plan view schematically illustrating a nick breaking device according to an embodiment of the present invention.
Figure 2:
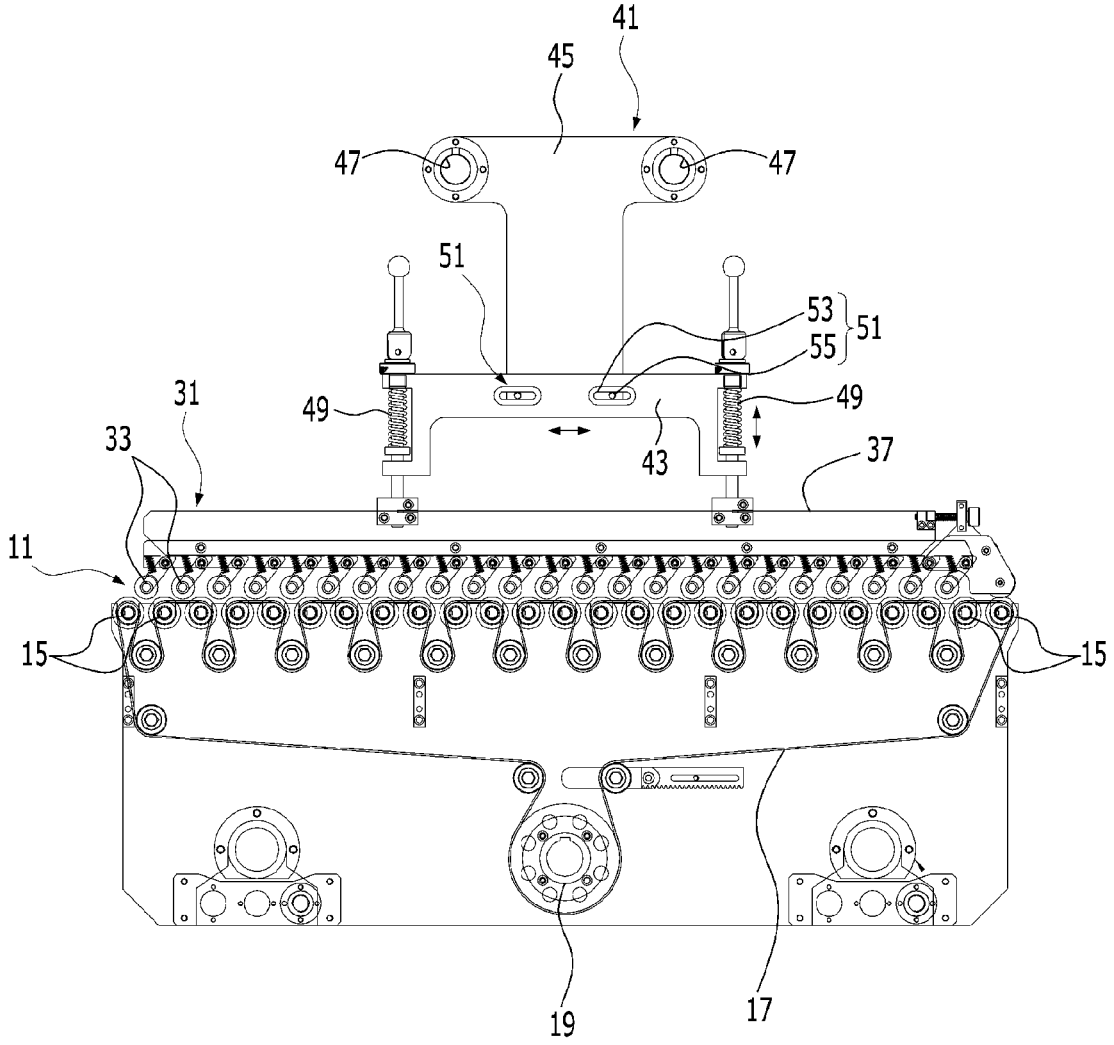
FIG. 2 is a front view of FIG. 1.
Figure 3:
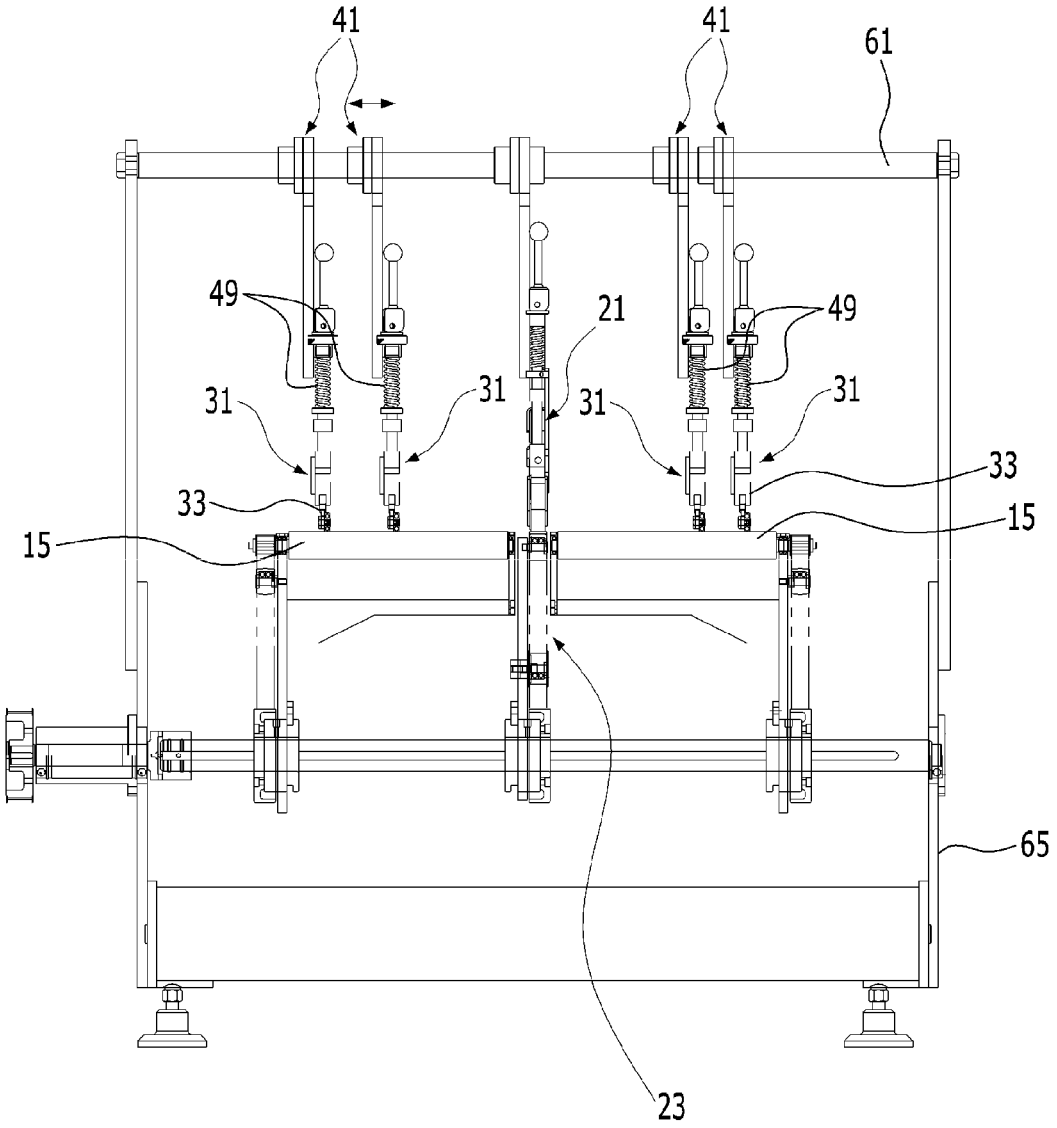
FIG. 3 is a side view of FIG. 1.

FIGS. 1 to 3 illustrate the nick breaking device according to an embodiment of the present invention.

As illustrated in the drawings, the nick breaking device 10 according to the embodiment of the present invention includes a conveyor 11, and a plurality of pressing rollers 33 that break a nick 6 formed in a plate-shaped element 1 that is transferred along a conveyor 11.

The conveyor 11 forms a transfer path 13 for transferring the plate-shaped element 1, and a plurality of transfer rollers 15 are disposed in two rows to be flat at an interval along the transfer path 13.

The transfer rollers 15 of the conveyor 11 are connected to a power transmission unit such as a belt 17, and receives a rotational force of the motor 19 to roll.

An upper transfer belt carrier 21 and a lower transfer belt carrier 23 are disposed at the center of the transfer path 13 of the conveyor 11 in an upward/downward direction of the transfer path 13. The upper transfer belt carrier 21 and the lower transfer belt carrier 23 adhere the plate-shaped element 1 introduced into the conveyor 11 to transfer the plate-shaped element 1 along the transfer path 13.

The pressing roller 33 is provided on the transfer path 13 of the conveyor 11, in more detail, on a transfer path of the nick 6 of the plate-shaped element 1, to break the nick 6 of the plate-shaped element 1.

The plurality of pressing rollers 33 are disposed in a row along the transfer path 13 of the conveyor 11 to form one pressing roller unit 31. Meanwhile, in the embodiment, four pressing roller units 31 are provided in four rows at an interval along the transfer path 13 of the conveyor 11, but the present invention is not limited thereto, and one or more pressing roller units 31 may be provided. Further, the locations of the pressing roller units 31 are adjusted along the transfer path of the nick 6 of the plate-shaped element 1 on the transfer path 13 of the conveyor 11. Further, the pressing roller unit 31 may include one or more pressing rollers 33.

Meanwhile, the pressing roller 33 is provided between a pair of adjacent transfer rollers 15. In more detail, a rolling surface of the pressing roller 33 that contacts the plate-shaped element 1 is disposed to be located below a rolling surface of the transfer roller 15 that contacts the plate-shaped element 1.

Accordingly, because the roller surface of the transfer roller 15 and the rolling surface of the pressing roller 33 that contact the plate-shaped element 1 are not located on the same plane but form a step, the plate-shaped element 1 forms a continuous wave shape and is transferred along the transfer path 13.

Accordingly, as the pressing roller 33 presses the plate surface of the plate-shaped element 1 including the flap 3 while the plate-shaped element 1 is transferred along the transfer path 13, the remaining area except for the flap 3 is lowered to the lower side of the transfer path 13 through pressing of the pressing roller 33 after being lifted to the upper side of the transfer roller 13, and the plate-shaped element 1 is transferred while forming a continuous wave shape as a whole as the series of lifting and lowering are repeated. Further, the flap 3 is continuously pressed by the plurality of pressing rollers 33 while being transferred along the transfer path 13, the nick 6 connecting the flap 3 is broken so that the cutting line 5 of the flap 3 is separated from the plate surface of the plate-shaped element 1.

Meanwhile, the plurality of pressing rollers 33 are supported by springs 35, respectively, and the springs 35 provide resilient forces to the pressing rollers 33 such that the pressing rollers 33 contact the nick 6 of the plate-shaped element 1.

Further, the springs 35 are supported by roller carriers 37, respectively.

The roller carriers 37 are provided in correspondence to the pressing roller units 31, respectively, and in the embodiment, four roller carriers 37 are disposed in four rows at an interval along the transfer path 13 of the conveyor 11 in correspondence to the four pressing roller units 31.

Meanwhile, the roller carriers 37 are supported by a carrier support part 41. The carrier support pate 41 includes a body 43, a connecting bracket 45 coupled to a guide rail 61, which will be described below, to be movable to connect the body 43 to the guide rail 61, a height adjusting bolt 49 that connects the body 43 to the roller carrier 37 and adjusts the height of the roller carrier 37 with respect to the transfer path 13 of the conveyor 11, and a location movement adjusting part 51 that adjusts a location movement of the roller carrier 37 along the transfer path 13 of the conveyor 11.

The height adjusting bolts 49 are coupled to opposite sides of the body 43, and the body 43 is connected to the roller carrier 37 by the height adjusting bolt 49.

One end of the connecting bracket 45 is coupled to the body 43 by the connecting member 55, which will be described below, and a pair of through holes 47 coupled to the pair of guide rails 61 to be slid are formed at an opposite end of the connecting bracket 45.

One end of the height adjusting bolt 49 is coupled to the roller carrier 37, and an opposite end of the height adjusting bolt 49 is screw-coupled to the body 43. The roller carrier 37 is lowered when the height adjusting bolt 49 is rotated in one direction and is lifted when the height bolt 49 is rotated in an opposite direction.

Accordingly, the height of the roller carrier 37 may be adjusted according to the thickness of the plate-shaped element 1 that is transferred along the transfer path 13 of the conveyor 11 through the manipulation of the height adjusting bolt 49.

Here, it is illustrated in the embodiment that the pair of height adjusting bolts 49 are provided on opposite sides of the body 43, but the present invention is not limited thereto and one or more height adjusting bolts 49 may be provided.

The location movement adjusting part 51 includes a pair of slits 53 that is partially formed in the plate surface of the body 43 to be parallel to the arrangement of the transfer roller 15, and a pair of connecting members 55 coupled to the slit 53 to be movable to connect the body 43 and the connecting bracket 45.

Accordingly, as the connecting member 55 is moved to one side or an opposite side of the slit 53, the location of the roller carrier 37 may be adjusted along the transfer path 13 of the conveyor 11.

Here, it is illustrated in the embodiment that the pair of slits 53 and the pair of connecting members 55 are provided, but the present invention is not limited thereto and one or more slits 53 and one or more connecting member 55 may be provided.

Further, the nick breaking device 10 according to the embodiment of the present invention further includes a pair of guide rails 61, to which the carrier support part 41 is coupled to be movable.

The pair of guide rails 61 are disposed on the upper side of the conveyor 11 to be spaced apart from each other transversely at an interval with respect to the transfer path 13 of the conveyor 11 and are coupled to the through holes 47 of the carrier support pate 41, respectively.

Accordingly, according to the location of the nick of the plate-shaped element 1 that is transferred along the transfer path 13 of the conveyor 11, in more detail, according to the transfer path of the nick 6 of the plate-shaped element 1, the location of the pressing roller 33 may be conveniently adjusted so that the nick 6 may be broken.

Here, it is illustrated in the embodiment that a pair of guide rails 61 are provided, but the present invention is not limited thereto and one or more guide rails 61 may be provided.

Further, reference numeral 65 denotes a frame that forms the frame of the nick breaking device 10 according to the embodiment of the present invention.

A process of breaking the nick 6 formed in the two flaps 3 as illustrated in FIG. 5 by using the nick breaking device 10 having the above configuration according to an embodiment of the present invention will be described below.

First, the locations of the roller carriers 37 are adjusted in correspondence to the location of the nick 6 of the plate-shaped element 1 that is to be introduced into the conveyor 11. Then, the locations of the roller carriers 37 are adjusted by sliding the carrier support part 41 along the guide rail 61.

The heights of the roller carriers 37 are adjusted by manipulating the height adjusting bolts 49 of the carrier support part 41 in correspondence to the thickness of the plate-shaped element 1 that is to be introduced into the conveyor 11. Then, the heights of the roller carriers 37 are adjusted such that the rolling surface of the transfer roller 15 and the rolling surface of the pressing roller 33, which contact the plate-shaped element 1, are not located on the same plate but form a step, for example, the roller surface of the pressing roller 33 that contacts the plate-shaped element 1 is located below the rolling surface of the transfer roller 15 that contact the plate-shaped element 1.

Further, the locations of the roller carriers 37 are located along the transfer path 13 of the conveyor 11 by moving the connecting members 55 of the carrier support part 41 to one side or an opposite side of the slit 53.

Here, the locations of the roller carriers 37 may be selectively adjusted according to necessities.

Further, the plate-shaped element 1 is transferred along the transfer path 13 of the conveyor 11 by introducing the plate-shaped element 1 into the conveyor 11.

Figure 4:
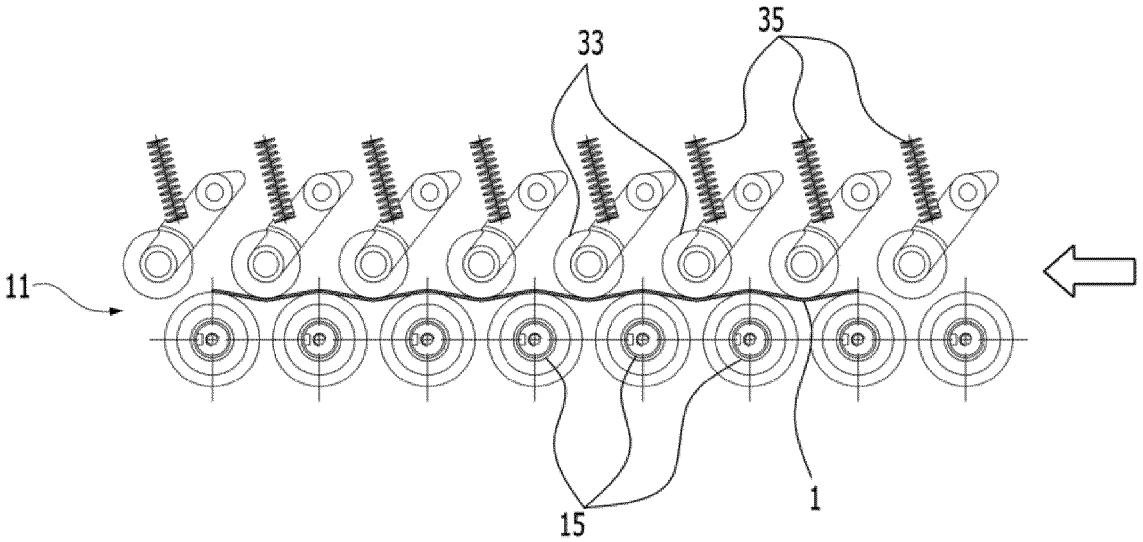
FIG. 4 is an enlarged view of a front side of a main part, which illustrates a process of transferring a plate-shaped element to the nick breaking device of FIG. 1.

Then, the plate-shaped element 1 introduced into the conveyor 11 is transferred along the transfer path 13 of the conveyor 11 while forming a continuous save as illustrated in FIG. 4 due to the step formed between the rolling surface of the transfer roller 15 and the rolling surface of the pressing roller 33, which contact the plate-shaped element 1.

Meanwhile, the plate-shaped element 1 is transferred while forming a continuous wave shape as a whole while the remaining areas, except for the flap 3, are repeatedly lifted and lowered as the pressing roller 33 presses the plate surface of the plate-shaped element 1 including the flap 3 while the plate-shaped element 1 is transferred along the transfer path 13, the flap 3 is continuously pressed by the plurality of pressing rollers 33, and the nick 6 connecting the flap 3 is broken so that the cutting line 5 of the flap 3 is separated from the plate surface of the plate-shaped element 1 as illustrated in FIG. 6.

In this way, according to the present invention, by pressing the plate-shaped element such that the plate-shaped element is transferred while forming a continuous wave shape and providing one or more pressing rollers that break the nick 6 formed in the plate-shaped element on the transfer path of the nick 6 of the plate-shaped element, the nick 6 of the plate-shaped element may be broken regardless of the length and the transfer speed of the plate-shaped element, the nick 6 may be broken regardless of the form and the location of the nick 6 of the plate-shaped element, and productivity may be improved.

It is apparent to those skilled in the art to which the present invention pertains that the present invention is not limited to the above-mentioned embodiments, but may be variously corrected and modified without departing from the spirit and scope of the present invention. Accordingly, the corrections and modifications shall pertain to the scope of the claimed of the present invention.

The invention claimed is:

1. A nick breaking device comprising:

a conveyor that forms a transfer path on which a plate-shaped element having a nick is transferred;

one or more pressing rollers provided on the transfer path of the nick of the plate-shaped element, configured to press the plate-shaped element such that the plate-shaped element forms a continuous wave shape, and configured to break the nick formed in the plate-shaped element;

a spring configured to provide a resilient force to the pressing roller such that the pressing roller contacts the nick of the plate-shaped element; and a roller carrier configured to support the spring.

2. The nick breaking device of claim 1, further comprising:

a plurality of transfer rollers disposed in a row at an interval along the transfer path of the conveyor to be rolled, wherein the pressing rollers are provided between the pair of adjacent transfer rollers.

3. The nick breaking device of claim 2, wherein a rolling surface of the pressing roller that contacts the plate-shaped element is located below a rolling surface of the transfer roller that contacts the plate-shaped element.

4. The nick breaking device of claim 1, further comprising:

a carrier support part configured to adjust a location of the roller carrier along the transfer path of the conveyor and configured to support the roller carrier such that a height of the roller carrier with respect to the transfer path of the conveyor is adjusted.

5. The nick breaking device of claim 4, further comprising:

a guide rail disposed on the upper side of the conveyor transversely with respect to the transfer path of the conveyor and to which the carrier support pate is coupled to be movable.

* * * * *